US006780460B1

(12) United States Patent
Ou-Yang

(10) Patent No.: US 6,780,460 B1
(45) Date of Patent: Aug. 24, 2004

(54) METHOD OF SCREEN PRINTING SHEER FABRIC

(75) Inventor: David T. Ou-Yang, Woodbury, MN (US)

(73) Assignee: Berwick Delaware, Inc., Wilmington, DE (US)

( * ) Notice: Subject to any disclaimer, the term of this patent is extended or adjusted under 35 U.S.C. 154(b) by 14 days.

(21) Appl. No.: 10/650,341

(22) Filed: Aug. 28, 2003

(51) Int. Cl.[7] ..... B05D 5/10

(52) U.S. Cl. ..... 427/208.4; 427/261; 427/265; 427/282; 427/288; 427/381; 427/389.9; 427/394

(58) Field of Search ..... 427/208.4, 261, 427/265, 282, 288, 381, 389.9, 394

(56) References Cited

U.S. PATENT DOCUMENTS

| | | | | |
|---|---|---|---|---|
| 3,419,413 | A | 12/1968 | Euforbia | 117/38 |
| 3,735,699 | A | 5/1973 | Koelschbach | 101/124 |
| 3,752,070 | A | 8/1973 | Jaffa | 101/123 |
| 4,251,276 | A | 2/1981 | Ferree, Jr. et al. | 106/27 |
| 4,273,042 | A | 6/1981 | Machida | 101/123 |
| 4,585,815 | A | 4/1986 | Ono et al. | 524/23 |
| 4,813,351 | A | 3/1989 | Pierson, Jr. | 101/115 |
| 5,067,400 | A | 11/1991 | Bezella et al. | 101/129 |
| 5,336,308 | A | 8/1994 | Lynn | 106/19 |
| 5,501,149 | A | 3/1996 | Schleinz et al. | 101/416.1 |
| 5,553,536 | A | 9/1996 | Van Os | 101/44 |
| 5,667,618 | A | 9/1997 | Lowther | 156/249 |
| 5,764,264 | A | 6/1998 | Takanaka | 347/104 |
| 5,769,931 | A | 6/1998 | Wang et al. | 106/31.38 |
| 6,020,397 | A | 2/2000 | Matzinger | 523/160 |
| 6,211,308 | B1 | 4/2001 | Saint Victor | 525/531 |
| 6,478,980 | B2 | 11/2002 | Nigam | 252/8.61 |
| 6,521,343 | B1 | 2/2003 | Samaranayake et al. | 428/407 |
| 2003/0018100 | A1 | 1/2003 | Foucher et al. | 523/160 |
| 2003/0062506 | A1 | 4/2003 | Nigam | 252/8.61 |
| 2003/0124045 | A1 | 7/2003 | Kobayashi et al. | 423/335 |

FOREIGN PATENT DOCUMENTS

| | | | |
|---|---|---|---|
| JP | 62190277 A | 2/1986 | C09D/11/10 |
| JP | 62290773 A | 6/1986 | C09D/11/02 |
| JP | 01174574 | 12/1987 | C09D/11/02 |
| WO | WO 02/057090 A1 | 7/2002 | B41M/5/00 |
| WO | WO 03/059972 | 7/2003 | C08F/265/060 |

OTHER PUBLICATIONS

The Condensed Chemical Dictionary, Tenth Edition, 1981, Revised by Gessner G. Hawley, Title Page, pp. 919–920, (no month avail.).

*Primary Examiner*—Bernard Pianalto
(74) *Attorney, Agent, or Firm*—Drinker Biddle & Reath LLP

(57) ABSTRACT

A method of printing sheer fabric is described. In accordance with the method, a supply of the sheer fabric and a supply of a release substrate having a width less than the width of the sheer fabric are provided. A low tack adhesive is applied to an endless belt. The sheer fabric and the release substrate are combined such that the edges of the fabric overhang the edges of the release substrate and the overhanging edges of the sheer fabric and the release substrate are temporarily affixed to the endless belt with the low tack adhesive. The combined sheer fabric and release substrate are conveyed on the endless belt through one or more printing stations where at least one color ink is printed on the sheer fabric. The ink is dried and the sheer fabric is separated from the release substrate.

31 Claims, 2 Drawing Sheets

METHOD OF SCREEN PRINTING SHEER FABRIC

FIELD OF THE INVENTION

The invention relates to the field of fabric printing and particularly to screen printing sheer fabric.

BACKGROUND OF THE INVENTION

Sheer fabric is a fabric with many holes or voids. Ninety-five percent or more of the fabric area may consist of holes in between the individual strands of fabric. Such fabric is generally "see-through" in nature. Sheer fabric can be used to make a diverse array of articles. Some of the articles commonly made from sheer fabric include decorative ribbons, stockings, and T-shirts.

One method of printing on fabric in general is screen printing, which involves a screen that has been selectively masked with a stencil. The article to be printed is supported on a table and the screen brought to bear against the article. A squeegee is moved across the screen to push ink through openings in the stencil and create an image on the article. Automated processes can produce printed articles quickly. Such processes involve affixing the articles to an intermittently moving conveyer belt by suction or other means. The conveyer belt moves the articles to a reciprocating screen, pauses to allow the screen to print and then moves the articles again when printing has been accomplished.

However, printing on sheer fabric has proven to be especially difficult. If conventional screen printing techniques are attempted on sheer fabric, the ink flows through the many holes in the fabric onto the conveyer or support table. The ink inevitably collects on these surfaces and must be periodically cleaned. The occurrence of ink penetrating through the holes in the fabric may be referred to as ink strikethrough.

Ink strikethrough is an especially big problem in automated processes because strikethrough can build up quickly and clog moving parts in the printing apparatus. Thus, a production line employing a screen printing unit must be frequently shut down and cleaned.

A need exists for an efficient and economical method of printing on sheer fabric.

SUMMARY OF THE INVENTION

A supply of sheer fabric to be printed is provided. A supply of a release substrate having a width less than the width of the sheer fabric is also provided. Preferably, both supplies are provided in the form of supply rolls and the rolls are mounted proximate an endless belt. A low tack adhesive can be applied to the endless belt. The sheer fabric and the release substrate are combined such that the edges of the fabric overhang the edges of the release substrate. The overhanging edges of the sheer fabric and the release substrate are temporarily affixed to the endless belt.

The combined sheer fabric and release substrate are conveyed on the endless belt through one or more printing stations where at least one color ink is printed on the sheer fabric. The ink is dried and the sheer fabric is separated from the release substrate.

BRIEF DESCRIPTION OF THE DRAWINGS

For the purpose of illustrating the invention, there is shown in the drawings a form which is presently preferred; it being understood, that this invention is not limited to the precise arrangements and instrumentalities shown.

DETAILED DESCRIPTION OF THE DRAWINGS

Figure 1:
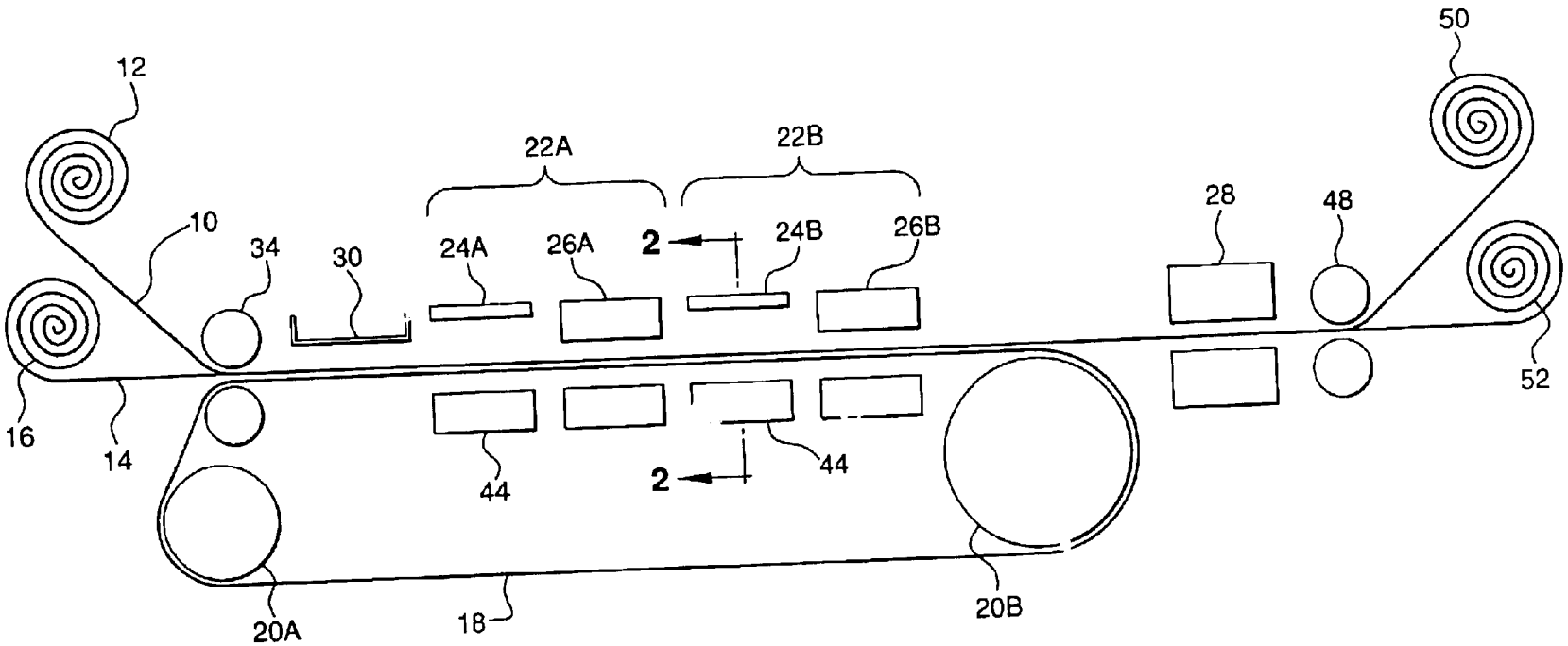
FIG. 1 is a schematic representation of a method of printing sheer fabric according to the present invention.

In the Figures, wherein like reference numerals indicate like elements, there is shown a preferred embodiment of a printing process according to the present invention. The process is used to print a sheer fabric 10.

Sheer fabric is fabric with a large number of holes or voids through which ink has a tendency to pass or strike through. More specifically, as used herein, the term sheer fabric means a fabric in which the holes or voids make up more than about fifty percent of the fabric area. Often, ninety-five percent or more of the fabric area may consist of holes. Such fabrics are generally see-through and are used for making many different articles, such as decorative ribbons, stockings, T-shirts and the like. The sheer fabric may be polyester, polyamide, acetate, rayon or any other fabric with a large number of holes or voids. Sheer fabrics are typically quite thin, but the exact thickness of the fabric is not critical to practicing the invention.

Where the sheer fabric 10 is provided in a supply roll 12, it can have any length. In fact, the supply of sheer fabric to be printed can be infinite, such as by connecting the leading edge of second and subsequent supply rolls to the trailing edge of the first supply roll 12. However, the sheer fabric to be printed must have a known width.

A supply of a release substrate 14 is provided for temporarily combining with the sheer fabric 10 during the printing process. The release substrate should be a material that will not be adversely affected by the drying processes described below and can be selected in accordance with the following description. Such materials include those that can withstand temperatures of up to about 300 degrees F. (150 degrees C.) that are associated with thermal drying units if solvent-based, water-based or plastisol inks are used. It is also possible to use electron beam or ultraviolet curable inks, in which case the release substrate 14 should be selected to withstand conditions in energy curing (drying) units.

Presently, paper is preferred as the release substrate. The release substrate can be coated on one or both sides with an appropriate release coating, such as a silicone release coating, to facilitate separation of the release substrate from the sheer fabric after ink has been printed and dried thereon. The release substrate 14 is preferably provided in a release substrate supply roll 16, the length of which can be matched to the length of the fabric supply roll 12. The release substrate 14 that is selected for a particular sheer fabric 10 to be printed should have a width less than the known width of sheer fabric 10. If the sheer fabric 10 has a variable width, the width of the release substrate 14 must be narrower than the greatest width of the sheer fabric 10. However, the width of the release substrate is preferably narrower than the shortest width of the fabric. On the other hand, it will be clear from the following description that the printable area of the fabric will be generally limited to the width of the release liner. Thus, the release substrate should be as wide as practicable to maximize the printable area.

The fabric supply roll 12 and release substrate supply roll 16 are set up in proximity to an endless belt 18, which runs between a pair of wheels 20A, 20B. One or both of these wheels 20A, 20B can be powered to drive the endless belt in a circular motion through one or more printing stations 22, each of which includes a screen printing unit 24 and an intermediate drying station 26. The endless belt can be made of a material with adequate strength, stretch resistance and heat resistance to convey the fabric 10 and release substrate 14 through the printing units and intermediate drying stations 26. Polyester is one such material. Each printing station is adapted to print a single-color repeat pattern on the fabric 10.

Two printing stations 22A, 22B are shown in FIG. 1. Such a configuration is preferred if two colors are to be printed on the sheer fabric. An additional printing station 22 may be added for each additional color to be printed. Alternatively, a single printing station 22 can be used if only one color is to be printed. Where more than one printing station 22 is provided, the screen printing units 24 should be spaced apart by a distance corresponding to an increment of the length of the repeat pattern to be printed. Thus, a distance of one, two, three or more repeat images may be provided between the screen printing units 24 to provide room for an intermediate drying station 26 between the screen printing units 24. When appropriately positioned, the second 22B and subsequent printing stations can print images of the desired additional colors in registration with the image printed by the first print station 22A. The intermediate drying units 26 can dry or cure the ink applied by the upstream screen printing unit 24 prior to further printing by the subsequent screen printing unit in order to avoid smearing of the previously printed image.

Figure 2:
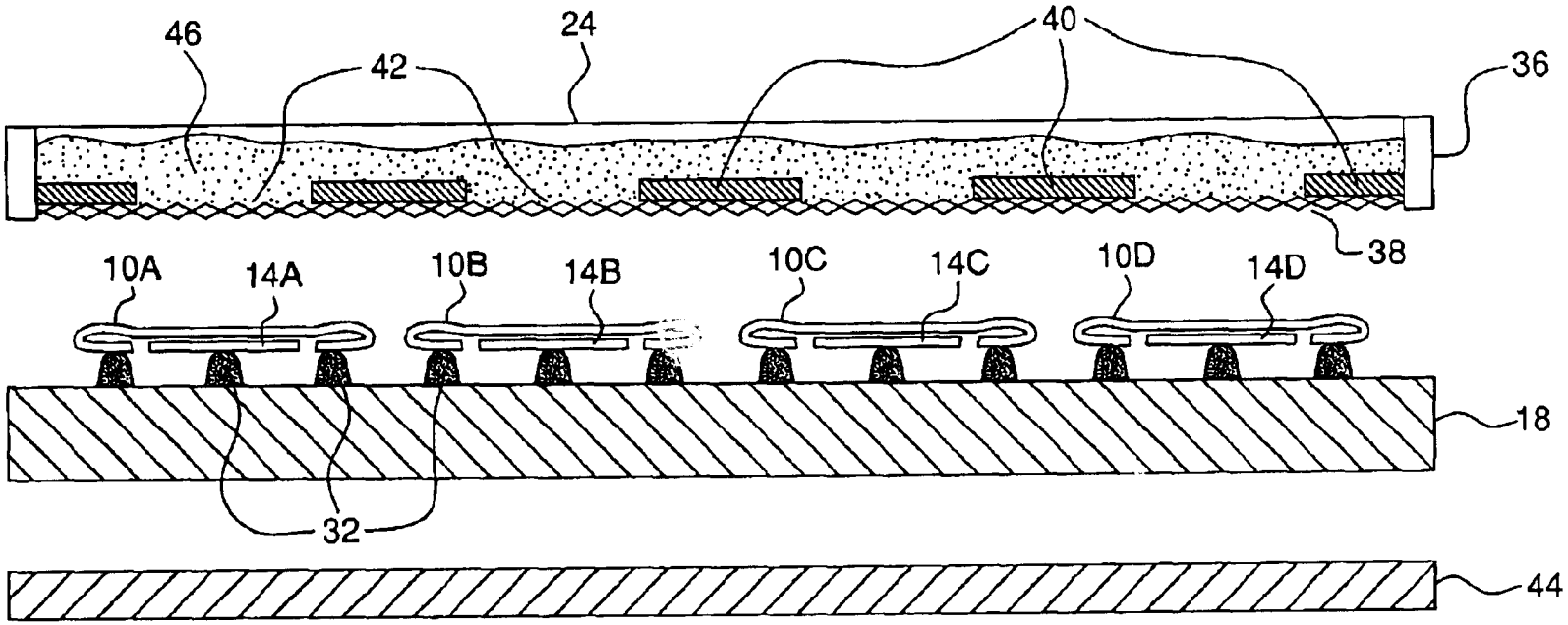
FIG. 2 is a schematic cross-sectional view, taken along line 2—2 of FIG. 1, of a fabric and release substrate at a printing unit.

The operation of the printing process will now be described with reference to FIGS. 1 and 2, FIG. 2 showing a cross-sectional schematic view through the endless belt 18, fabric 10 and release substrate 14 as they are run through a screen printing unit 24. Prior to unwinding the fabric supply roll 12 and release substrate supply roll 16, an adhesive applicator 30 can be reciprocated into a position proximate the endless belt 18. The adhesive applicator 30 can be a drip pan with holes in the bottom for dispensing a quantity of adhesive. The adhesive can be any low tack adhesive that exhibits a release value of less than 1000, and preferably less than 500 grams per 2.54 cm. If the adhesive exhibits a release value higher than 1000 g/2.54 cm, it is possible that the release substrate 14 can fail (i.e. exfoliate or otherwise partially block or stick to the printed fabric) after the final drying step, which is described below.

A coating of low tack adhesive can be applied to the endless belt in lines or as a substantially solid coating. Preferably, the low tack adhesive is dispensed from the drip pan 30 while the endless belt is running to form lines of adhesive 32, prior to running the sheer fabric 10 and release substrate 14 onto the belt 18. The endless belt 18 travels for a complete cycle while the adhesive lines 32 are dispensed so that the entire length of the endless belt 18 is provided with the adhesive lines 32. If it is found that the adhesive exhibits too much tack, a tack reducing agent, such as a powder, can be applied over the adhesive to provide it with a release value within the desired range. Thus, the step of applying a low tack adhesive can include the steps of applying a high tack adhesive and applying a tack reducing agent.

Once the adhesive lines 32 have been applied to the endless belt 18, the adhesive applicator 30 can be reciprocated away from the endless belt 18 and the endless belt 18 is ready to receive the sheer fabric 10 and release substrate 14. If the sheer fabric 10 is narrow, such as in the case of a decorative ribbon, in comparison with the width of the endless belt 18 and screen printing unit 24, several webs of fabric 10 can be run through the printing process simultaneously. FIG. 2 shows four such webs of fabric 10A through 10D in the form of decorative ribbons having folded lateral edges, which can be sown for reinforcement. The edges of the ribbon can be further reinforced with additional sheer or non-sheer fabric, thin wires or both (not shown).

Each web of sheer fabric 10A through 10D is combined with a release substrate 14A through 14D that is narrower in width than the fabric. The fabric 10 and release substrate 14 are combined and pressed against the adhesive-coated endless belt 18 at a pair of nip rolls 34. As shown in FIG. 2, the edges of the sheer fabric 10 overhang the edges of the release substrate 14. Thus, when pressed against the endless belt 18, the overhanging edges of the fabric 10 and the underlying release substrate 14 contact the lines of adhesive 32 and become temporarily affixed to the endless belt 18. (It should be noted that the edges of the fabric 10 will become temporarily affixed to the endless belt 18 regardless of whether or not the edges are folded as shown, or otherwise reinforced.) It is also possible to utilize an endless belt with small holes connected to a vacuum source, instead of the low tack adhesive, to affix the fabric and release liner to the endless belt. Such a vacuum system may be appropriate where the many holes of the overhanging edges of the sheer fabric are adequately occluded, such as by reinforcement, multiple folding of the edges or otherwise, so that the edges are suitably influenced by the vacuum.

The endless belt 18 is configured to be intermittently driven during the printing process while the fabric 10 and release substrate 14 are affixed thereto. To prepare for printing, the endless belt 18 is driven forward to convey the combined fabric 10 and release substrate 14 to the printing station 22A. The endless belt 18 is stopped when appropriately positioned. The screen printing unit 24A is reciprocated downwardly to print a repeat image of a desired color on the fabric 10, as described in more detail below. Upon completion of the printing, the screen printing unit 24A is reciprocated away from the fabric 10. Once the screen printing unit 24A is reciprocated away, the endless belt 18 travels a distance corresponding to the length of the repeat image and again stops. The printing unit 24A again reciprocates into contact with the fabric 10 and prints the second occurrence of the repeat image such that the leading edge of the second printed repeat image is adjacent the trailing edge of the first printed repeat image to create a continuously printed pattern. Upon completion of the second printing, the screen printing unit 24A reciprocates away and the endless belt 18 travels again.

As the endless belt 18 continues to intermittently travel, the first repeat-image-printed portion of the fabric 10 is conveyed through the intermediate drying station 26A and into the second printing unit 22B. During the intermittent travel of the belt, the leading edge of the first repeat-image-printed portion stops at the downstream end of the second screen printing unit 24B of the printing station 22B. The second screen printing unit 24B reciprocates downwardly simultaneously with the screen printing unit 24A to contact and print a second color in registration with the first repeat image. If desired, registration marks may be pre-printed on the fabric 10 or printed at the first screen printing unit 24A to assist in registration. The two-color repeat image subsequently travels through the second intermediate drying station 26B and through as many additional printing stations as are needed to print the number of colors desired.

The method of printing at each screen printing unit 24 is similar. The screen printing unit 24 includes an ink frame 36 and a screen 38. The screen can have a high mesh count per inch if fine images are to be printed, or a lower mesh count per inch if less detailed images are desired or if the ink contains puff or other special additives. Experimentation has shown that a screen with a mesh count of 125 per inch works well for most inks. A mesh count of 81 per inch has proven to be suitable for puff inks. However, screens with mesh counts in the range of 10 to 500 per inch, and preferably 50 to 200 per inch, are believed to be suitable.

The screen 38 is provided with a stencil 40 to mask discrete areas and therebetween form image-forming apertures 42 that correspond with the image to be formed. The stencil 40 can be formed on the screen by known methods. For example, an energy curable material can be coated onto the screen 38 and selectively cured to form the stencil 40 where desired. The uncured material can be subsequently removed from the screen by washing or the like to create the desired image-forming apertures 42. The image-forming apertures 42 can be in the shape of any desired pattern to be printed, flowers, harts and stars being just a few examples.

Although the image-forming apertures 42 can be in any desired shape and size, it is preferred that the image-forming apertures 42 be limited to areas of the screen 38 that ultimately correspond with portions of the fabric 10 that directly overlay the release substrate 14. This correspondence ensures that the release substrate 14 will collect or block any ink strikethrough resulting from printing on the sheer fabric 10 through the image-forming apertures 42. However, the correspondence is not always necessary. For example, if the fabric 10 is reinforced with non-sheer fabric or another low-ink-permeable material at its edges, the edge areas will not permit ink strikethrough and local masking at the edges would not be required. As such, images can, in fact, be printed on such reinforced edges if desired.

When at a screen printing unit 24, the endless belt 18 is preferably supported by a support table 44. During a print cycle, the frame 36 of the screen printing unit 24 is filled with an ink 46. The screen printing unit 24 reciprocates downwardly and a squeegee (not shown) moves across the screen 38 and forces ink through the image-forming apertures 42 onto the sheer fabric 10 to form an image. During the process, ink strikethrough collects on the release substrate 14. Once the squeegee has completed its cycle, the screen printing unit 24 reciprocates away from the fabric 10 so that the endless belt 18 can again travel. The ink collected on the release substrate will not smear during subsequent travel of the endless belt 18 because the sheer fabric 10 and release substrate 14 are fixed relative to each other by the low tack adhesive lines 32.

If the sheer fabric is a tubular structure, such as a T-shirt or stockings, the release substrate can be inserted into the tubular structure in order to prevent ink strikethrough from coloring the bottom side of the tubular structure. The release substrate can be inserted manually or by an automated apparatus, which holds the tubular structure open prior to placing it on the endless belt. The portion of the tubular structure extending past the release substrate as it surrounds the release substrate forms an overhanging edge. Such structures can be run through the printing process twice if it is desired to print both sides of the tubular structure. In such a process, the spacing of the screen printing units should be adjusted to an increment of the printed image large enough to accommodate the article.

Once printing and intermediate drying has been completed at each of the desired printing stations 22, the sheer fabric 10 and release substrate 14 can be separated from the endless belt 18. A final drying station 28 is provided beyond the endless belt 18. At the final drying station 28, the ink is fully dried, preferably at a temperature of about 285 degrees F. If only one printing unit 22 is used, it may be possible to utilize the single intermediate drying station 26 as the final drying station provided that the endless belt is capable of repeated exposure to the final drying conditions and if a low tack adhesive is used that will not be adversely affected by those conditions. If the preferred PET belt is used, the temperature of such a combined drying station must be carefully selected to fully dry the ink, while not shrinking the belt. If higher temperatures are found to be required to fully dry the ink, a temperature resistant belt, such as one formed from silicone or a woven material, can be used.

Upon exiting the final drying station 28, the printed fabric 10 and release substrate 14 can pass through a pair of pre-separation rollers 48 and then separated. The sheer fabric can then be rewound onto a printed fabric take-up roll 50 and the release substrate wound onto a release substrate take-up roll 52. Upon separation, the cured or dried ink should release cleanly from the release substrate and remain on the sheer fabric as it is wound.

Having described the method of the present invention, particular inks and release substrates suitable for use therein will now be described. The release substrate can be selected based on an observed release force using test method ASTM D-3330 utilizing TESA 7475 with pressure sensitive adhesive as a testing tape. The test can be performed by rolling the tape onto the potential release substrate with a 4.5 pound roller at 73 degrees F. (22.8 degrees C.) and 50 percent relative humidity, at which conditions test tape and the release substrate can be preconditioned for 24 hours. The sample size can be 1 inch wide by 10 to 12 inches long. The test is performed by puling the tape away from the release substrate at a 180 degree angle at a speed of 12 inches per minute using an adhesion release tester such as model AR-1500, available from Cheminstruments, Inc. of Fairfield, Ohio.

Under the above testing conditions, suitable release substrates should exhibit a release force of less than 800 grams per 2.54 cm (g/2.54 cm). Preferably, the release force of the release substrate is between 5 and 400 g/2.54 cm, and is most preferably between 20 and 200 g/2.54 cm. If the release substrate exhibits a release force greater than 800 g/2.54 cm, there is a possibility that the cured ink will adhere to the release substrate, resulting in partial ink delamination when the printed fabric is separated from the release substrate after being drawn through the pre-separation rollers 48. Also, if the release substrate exhibits a release force greater than 800 g/2.54 cm, there is the further possibility that portions of the release substrate can experience Z-direction failure and stick to the printed fabric, especially when paper is used as the release substrate. Table 1 shows several examples of commercially available materials that have been found to be suitable for use with the current method and one comparative example.

TABLE 1

| Substrate | Manufacturer | Release Force (g/2.54 cm) |
|---|---|---|
| Tight Release Paper | Wausau's Coated Products, Wausau, WI | 179.24 |
| Medium Release Paper | Wausau's Coated Products, Wausau, WI | 16.08 |

TABLE 1-continued

| Substrate | Manufacturer | Release Force (g/2.54 cm) |
|---|---|---|
| Very Easy Release Paper | Wausau's Coated Products, Wausau, WI | 10.06 |
| 42ES6J | Eastern Paper, Brewer, ME | 18.16 |
| 42ES21G | Eastern Paper, Brewer, ME | 12.58 |
| Never Stik CIS 42ws6q | Eastern Paper, Brewer, ME | 87.84 |
| Never Stik CIS 42ws21p | Eastern Paper, Brewer, ME | 35.63 |
| Never Stik CIS 42ws17c | Eastern Paper, Brewer, ME | 13.46 |
| 4010HS | Laporex Inc., Willowsbrook, IL | 20.85 |
| 4030HS | Laporex Inc., Willowsbrook, IL | 134.72 |
| Comparative Example: | | |
| Super Calendered Paper (40 pound) | Wausau's Coated Products, Wausau, WI | 1362.84 |

As already noted, there are several inks that can be used in the method of the present invention. The preferred inks are plastisol inks, which include PLASTIPUFF ink, available from Union Ink Company, Inc. of Ridge Field, N.J., and Plastisol ML series ink available from Rutland, Inc. of Pineville, N.C. Solvent-based inks are also suitable. Such inks include SCREENFAB series ink and FABRISCREEN series ink, which are both available from Perfectos Printing Inks Co., Ltd. of Nottingham, England.

It has been found, however, that use of unmodified conventional screen printing inks can create an image that is somewhat blurred. In order to increase the sharpness of the printed image, a thixotropic agent, such as silica, can be added to the ink. The silica improves the thixotropic properties of the ink, increases the viscosity of the ink and provides improved image quality when printed on sheer fabric. Silica has been found to be an ideal additive because it does not significantly effect the color of the ink and can be easily compounded. In addition, the quantity silica required to improve the thixotropic properties of the ink is relatively small. The amount of silica that should be added to the ink depends on the nature of the ink. It is believed that the silica increases viscosity by forming a silica network through hydrogen bonding. Larger amounts of silica may be useful in inks with components that exhibit significant hydrogen bonding because the hydrogen bonding of the ink components can interfere with the silica network. Lesser amounts of silica can achieve the desired effect in inks that exhibit no hydrogen bonding.

The amount of silica required to achieve the desired effect for screen printing sheer fabric has been found to be less than four percent by weight in many inks. Specifically, testing of several inks has indicated that levels of silica between 0.3 percent and 4.0 percent by weight are suitable. Inks were loaded with various amounts of silica and tested to determine viscosity. The silica used was CAB-O-SIL M-5 fumed silica, obtained from Cabot Corp. of Boston, Mass. Viscosity data was obtained using a NAMETRE real time process viscometer using a spherical sensor with a shear rate of 4000 $sec^{-1}$ and at a temperature of 21.28 degrees C. Measurements were taken one minute and two minutes after insertion of the sensor into the ink. Table 2 summarizes the results of viscosity tests for Rutland Navy ink ML 240601 loaded with various levels of silica. All viscosity data is listed in centipoise (cp).

TABLE 2

| Weight percentage of Silica | Viscosity (cp) at 1 minute | Viscosity (cp) at 2 minutes |
|---|---|---|
| 0 | 4,679 | 5,060 |
| 0.3 | 6,657 | 6,919 |
| 0.6 | 6,683 | 6,926 |
| 0.9 | 7,100 | 7,396 |
| 1.2 | 8,432 | 8,878 |
| 1.5 | 9,099 | 9,615 |

Table 3 summarizes the results of viscosity tests for Rutland Black ink MH 839401 loaded with various levels of silica.

TABLE 3

| Weight percentage of Silica | Viscosity (cp) at 1 minute | Viscosity (cp) at 2 minutes |
|---|---|---|
| 0 | 4,209 | 4,271 |
| 0.3 | 5,062 | 5,260 |
| 0.6 | 5,453 | 5,641 |
| 1.2 | 6,465 | 6,710 |
| 1.5 | 7,789 | 7,785 |

Further testing revealed that Rutland Black puff ink NP 800001 with 1.8 percent silica added had a viscosity of 26,100 centipoise after 1 minute. Rutland Bright gold ink ML 476901 with 1.2 percent silica added had a viscosity of 12,590 after one minute and 13,880 after two minutes.

Inks were also tested for print quality. Tests were performed by printing various inks onto sheer fabric in accordance with the method described herein. The sheer fabric used for the test was sheer ribbon that is commercially available from Berwick Offray, LLC of Berwick, Pa. under the name Wired Arabesque number 15 6275. Table 4 summarizes test results of various commercially available plastisol inks with and without silica added. The results columns ("Unmodified" and "Silica Added") are presented in appearance values ranging from 1 to 5, where 1 represents a poor appearance and 5 represents a very good appearance. The "Amount" column indicates the weight percentage of silica in the ink evaluated in the "Silica Added" column.

TABLE 4

| Supplier | Color | Identifier | Unmodified | Silica Added | Amount |
|---|---|---|---|---|---|
| Rutland | Snap White | ML 92400 | 3+ | 4+ | 0.6% |
| Rutland | Bright gold | ML 476901 | 3+ | 5 | 1.2% |
| Rutland | Purple | ML 1569 | 1 | 4 | 1.5% |
| Rutland | Yellow | ML 461101 | 3+ | 5 | 1.2% |
| Rutland | Kelly green | ML 340801 | 3+ | 5 | 1.2% |
| Rutland | A-Red | ML 688901 | 3+ | 5 | 1.5% |
| Rutland | Navy | ML 240601 | 1 | 4+ | 1.5% |
| Rutland | Black | MH 839401 | 3 | 4+ | 1.5% |
| Rutland | Black puff | NP 800001 | 2 | 4+ | 1.8% |
| Rutland | Fluorence Pink | NP 600403 | 2 | 4+ | 2.0% |
| Union | White Plastipuff | PLPF-1052 | 2 | 5 | 1.6% |
| Union | Scarlet Red | PLPF-3010 | 2 | 4+ | 1.6% |

Table 5 summarizes test results of various commercially available solvent-based inks with and without silica added. The solvent-based inks reported in Table 5 are SCREENFAB DE5-5111 series inks obtained from Perfectos Printing.

The results were obtained using the same methods and reported in the same format as described in connection with the plastisol inks listed above.

TABLE 5

| Color | Identifier | Unmodified | Silica Added | Amount |
|---|---|---|---|---|
| Red | 85-01-1-181 | 2+ | 4+ | 1.5% |
| Mixing white | 85-01-M-white | 3 | 4+ | 0.6% |
| Violet | 85-01-1-2587 | 3+ | 4+ | 1.5% |
| Blue | 85-01-1-287 | 3+ | 5 | 1.5% |
| Green | 85-01-3308 | 3+ | 5 | 1.5% |
| Black | 85-01-M-black | 3+ | 4+ | 2.0% |

The appearance values in the above tables were assigned as follows. A value of 5 represents a very good appearance characterized by sharp, well-defined edges with no apparent blurring. A value of 4 represents a good appearance characterized by slight blurring of the image edges at the bottom of the fabric. A value of 3 represents a very fair appearance characterized by haze and noticeable blurring of the image edges throughout the fabric. A value of 2 represents a fair appearance with significant blurring of the image edges in which some image detail is indiscernible. A value of I represents a poor appearance characterized by messy edges where the image as a whole may not be discernable.

Other thixotropic agents can be added to the ink in addition to or in place of the above described silica to improve the thixotropic properties of the ink. Some thixotropic agents include aluminum stearate, which can be obtained from Ferro Corporation, Ohio, under the tradename SYNPRO 303, organic titanates, sold by DuPont, Wilmington, Del., under the name TYZOR, attapulgite based materials, such as ATTAGEL, sold by Engelhard Corp, N.J., clay minerals, such as bentonite, available from SC Mining GmbH, Germany, organically modified bentonite, such as TIXOGEL organoclay, also available from SC Mining, acrylic acid, crosslinked sodium polyacrylate, and polyacrylic acid, which are available from Nihon Junyaku Co., Ltd., Japan. It is contemplated that these and other materials can be used to improve the thixotropic properties and raise the viscosity of the ink. Inks having viscosity of greater than 6,000 centipoise and especially greater than 7,000 centipoise have been found to produce images of very good quality when printed on sheer fabric, with little or no blurring of the image edges. However, when adding a thixotropic agent to ink, care should be taken not to raise the viscosity of the ink excessively. After addition of the thixotropic agent, the ink should still flow through a screen with a mesh count of 150 per inch under influence of the squeegee in the screen printing unit to achieve high-quality printing. In the case of inks with puff or other special agents, it should be sufficient that the ink flow through a screen with a mesh count of 100 under influence of the squeegee.

A variety of modifications to the embodiments described will be apparent to those skilled in the art from the disclosure provided herein. Thus, the present invention may be embodied in other specific forms without departing from the spirit or essential attributes thereof and, accordingly, reference should be made to the appended claims, rather than to the foregoing specification, as indicating the scope of the invention.

What is claimed is:

1. A method of printing sheer fabric, the method comprising the steps of providing a supply of the sheer fabric and a supply of a release substrate having a width less than the width of the sheer fabric;

applying a low tack adhesive to an endless belt;

combining the sheer fabric and the release substrate such that the edges of the fabric overhang the edges of the release substrate;

temporarily affixing the overhanging edges of the sheer fabric and the release substrate to the endless belt with the low tack adhesive;

conveying the sheer fabric through one or more printing stations;

printing at least one color ink on the sheer fabric at the one or more printing stations;

drying the ink; and separating the sheer fabric from the release substrate.

2. The method of claim 1 wherein the step of providing the release substrate comprises the step of obtaining or making a substrate with a release force of less than 800 grams per 2.54 centimeters.

3. The method of claim 1 wherein the drying step comprises an intermediate drying step at an intermediate drying station after each of the one or more printing steps and a final drying step at a final drying station after all of the printing and intermediate drying steps.

4. The method of claim 3 further comprising the step of separating the fabric and release substrate from the endless belt after the intermediate drying steps and before the final drying step.

5. The method of claim 4 wherein the step of separating the fabric and the release substrate is performed after the final drying step.

6. The method of claim 1 wherein the applying step comprises dripping lines of the low tack adhesive from an adhesive applicator onto the endless belt as the belt is moving.

7. The method of claim 6 further comprising the step of reciprocating the adhesive applicator away from the endless belt after the applying step.

8. The method claim 1 further comprising the step of adding silica to the ink before the printing step.

9. The method of claim 8 wherein the amount of silica added to the ink is adequate to form an ink mixture of between about 0.3 and about 4.0 percent by weight of silica.

10. The method of claim 8 wherein the amount of silica added to the ink is adequate to form an ink mixture having a viscosity greater than 6,000 centipoise.

11. A method of printing sheer fabric comprising the steps of:

temporarily combining a release substrate and the sheer fabric on an endless belt using a single coating of adhesive;

running the combined sheer fabric and release substrate on the endless belt through one or more printing stations where ink is applied to the fabric and ink strikethrough coming through the sheer fabric contacts with the release substrate, and an intermediate drying station after each printing station;

separating the fabric and release substrate from the endless belt;

drying the combined fabric and release substrate at a final drying station; and separating the sheer fabric and release substrate.

12. The method of claim 11 wherein the ink applied has a viscosity of greater than 6000 centipoise.

13. The method of claim 11 wherein the ink applied comprises greater than about 0.3 weight percent silica.

14. The method of claim 11 wherein the temporarily combining step comprises the step of bringing together the sheer fabric and release substrate onto an endless belt such that the edges of the sheer fabric overhang the edges of the release substrate so that the overhanging edges and the release substrate contact the endless belt.

15. The method of claim 14 wherein the overhanging edges of the fabric and the release substrate are temporarily affixed to the endless belt with a low tack adhesive when the overhanging edges and the release substrate contact the endless belt.

16. The method of claim 11 wherein the sheer fabric is tubular and the temporarily combining step comprises the steps of inserting the release substrate into the tubular sheer fabric and adhering the sheer fabric on one side of the release substrate to the endless belt.

17. The method of claim 11 wherein the release substrate has a release force of less than 800 grams per 2.54 centimeters.

18. A method of screen printing sheer fabric comprising the steps of:

combining a release substrate and the sheer fabric on an endless belt by covering the release substrate with the sheer fabric such that edges of the sheer fabric overhang the release substrate and contact the endless belt;

temporarily adhering the overhanging edges of the sheer fabric to the endless belt;

conveying the combined release substrate and sheer fabric through one or more printing stations having a screen printing unit and an intermediate drying station;

at each of the one or more printing stations, screen printing an image on the sheer fabric, allowing ink strikethrough to collect on the release substrate, and at least partially drying the ink;

further drying the ink at a final drying station; and separating the release substrate and sheer fabric.

19. The method of claim 18 wherein the screen printing step comprises applying an ink having a viscosity of greater than 6000 centipoise.

20. The method of claim 19 further comprising the step of adding silica to the ink prior to the printing step.

21. The method of claim 18 further comprising the step of coating a low tack adhesive on the endless belt prior to the combining step.

22. The method of claim 18 wherein the combining step comprises the steps of bringing the release substrate into contact with the endless belt and bringing the sheer fabric into contact with the release substrate such that the edges of the fabric overhang the release substrate and contact the endless belt.

23. The method of claim 18 wherein the sheer fabric is a tubular structure and the combining step comprises the steps of placing the release substrate inside the tubular structure and bringing the tubular structure into contact with the endless belt.

24. A method of printing sheer fabric, the method comprising the steps of:

mixing an ink composition with a thixotropic agent;

combining the sheer fabric with a release substrate such that the sheer fabric and release substrate are fixed relative to one another;

screen printing the ink onto the sheer fabric side of the combined sheer fabric and release substrate such that ink strikethrough collects on the release substrate;

drying the ink; and separating the sheer fabric and the release substrate.

25. The method of claim 24 wherein the mixing step comprises adding silica to the ink mixture.

26. The method of claim 24 wherein the mixing step comprises adding silica to the ink mixture at a weight percent of between 0.3 percent and 4.0 percent.

27. The method of claim 24 wherein the mixing step comprises adding a thixotropic agent to the ink until the ink has a viscosity of greater than 6,000 centipoise.

28. The method of claim 24 wherein the mixing step comprises adding a thixotropic agent to the ink until the ink has a viscosity of greater than 7,000 centipoise, but can still flow through a screen with a mesh count of 150 per inch under influence of a squeegee.

29. A method of printing sheer fabric comprising the steps of:

providing the sheer fabric;

mixing an ink composition with a thixotropic agent in an amount sufficient to provide the ink with a viscosity greater than 6,000 centipoise, but so the ink can flow through a screen with a mesh count of 150 per inch under influence of a squeegee; and applying the ink to the sheer fabric in a pre-selected pattern.

30. The method of claim 29 wherein the mixing step comprises the step of adding silica to the ink.

31. The method of claim 29 wherein the mixing step comprises the step of adding silica to the ink composition in an amount of from 0.3 percent to 4.0 percent by weight.

* * * * *